United States Patent [19]

Chatterjee et al.

[11] Patent Number: 4,950,450

[45] Date of Patent: Aug. 21, 1990

[54] NEODYMIUM IRON BORON MAGNETS IN A HOT CONSOLIDATION PROCESS OF MAKING THE SAME

[75] Inventors: Dilip K. Chatterjee; Thomas W. Martin; Paul D. Askins, all of Rochester, N.Y.

[73] Assignee: Eastman Kodak Company, Rochester, N.Y.

[21] Appl. No.: 222,591

[22] Filed: Jul. 21, 1988

[51] Int. Cl.[5] ..... B22F 1/00

[52] U.S. Cl. ..... 419/10; 419/12; 419/23; 419/48; 419/60; 148/101; 148/105; 148/121; 148/130; 75/244; 75/245

[58] Field of Search ..... 148/302, 101, 105, 121; 75/245, 244; 419/10, 12, 23, 48, 60

[56] References Cited

U.S. PATENT DOCUMENTS 4,144,060 3/1979 Jandeska et al. ..... 75/226
4,597,938 7/1986 Matsuura et al. ..... 419/23
4,710,239 12/1987 Lee et al. ..... 148/101

FOREIGN PATENT DOCUMENTS 0133757 3/1985 European Pat. Off. .

*Primary Examiner*—Stephen J. Lechert, Jr.
*Assistant Examiner*—Nina Bhat
*Attorney, Agent, or Firm*—Robert A. Gerlach

[57] ABSTRACT

A method of making high energy Nd-Fe-B magnets having a mass less than 30 grams wherein an alloy of said materials having a grain size less than that desired in the finished magnet is first prepared and subsequently hot worked to the desired configuration with increased magnetic properties and density by introducing into a cavity formed by a die and punch a Nd-Fe-B alloy powder having a particle size of from 45 μm to 250 μm and a grain size of from 100 to 1500 angstroms, compressing the powder at a temperature of from about 550° C. to 750° C. under a die-punch pressure of at least 10 kpsi under a vacuum of less than 200 millitorr to achieve a permanent magnet having a remanence of at least 7 kilogauss.

12 Claims, No Drawings

NEODYMIUM IRON BORON MAGNETS IN A HOT CONSOLIDATION PROCESS OF MAKING THE SAME

FIELD OF THE INVENTION

This invention relates to a method of making neodymium iron boron magnets by a hot consolidation technique and more importantly, to a method of making substantially fully dense, high energy neodymium iron boron magnets having a mass less than 30 grams.

BACKGROUND OF THE INVENTION

It is known in the art to form ribbons of neodymium iron boron alloys by a melt spinning process wherein a suitable alloy in molten condition is directed onto a chill surface of a copper wheel spinning at high speed. In European Patent Application No. 0 133 757 published Mar. 6, 1985, this technique is employed in order to prepare an "overquenched" material. The speed that the wheel turns determines the quench rate of the ribbons that are formed thereon and in turn determines the grain characteristics of the ribbons formed. The speed can be varied to produce amorphous ribbons, fine grained ribbons or large grained ribbons. As the speed increases, the grain size of the ribbons decreases. By "overquenching" material the publication means an amorphous or extremely fine crystal structure, generally less than 20 nanometers in the largest direction. The publication discloses that by hot working such amorphous to finely crystalline solid material to produce a plastically deformed body a magnetically anisotropic permanent magnet results. In Example 1 therein, overquenched alloy is placed into a cylindrical cavity of a round die having upper and lower punches. The die and its contents were rapidly heated under argon with an induction coil to a maximum temperature of 750°. The upper punch exerts a pressure of 32,000 psi to produce a hard strong cylinder having full density. While the mass of the resulting cylinder prepared in this example cannot be directly determined, the original alloy utilized in the preparation of the overquenched ribbons is said to be made up of 40 grams of the mixture of elemental materials. Nowhere is there an indication that less than all of this material is employed in the preparation of the cylinder said to have full density.

It has been learned experimentally that the procedure described in the above-mentioned publication is not suitable for preparing permanent magnets having a mass less than 30 grams because as the mass decreases below 30 grams and particularly below 20 grams full density becomes an unrealized goal. Since the purpose of making high energy magnets is to make smaller devices, such as electric motors, it is extremely important to fabricate magnets having not only the desired configuration but a very small size. In automotive use, for example, many small motors are required. Opening and closing windows is one application among many other applications. It is therefore desired to produce smaller devices having the same power as larger devices previously known and to achieve this goal, smaller magnets must be employed. This object is further enhanced by providing a method by which the small mass magnets can be prepared directly without the need of subsequent machining operations.

SUMMARY OF THE INVENTION

The invention provides a method of making high energy neodymium iron boron magnets having a mass less than 30 grams and being substantially fully dense by compressing a neodymium iron boron alloy powder having a particle size of from 45 micrometers to 250 micrometers in a die and punch assembly at a pressing pressure of at least 10 kpsi and a temperature of from 550° C. to 750° C. under a vaccum of less than 200 millitorr to achieve a permanent magnet having a remanence of at least 7 kilogauss. When making magnets having a mass less than 30 grams and particularly less than 20 grams, it has been found that in order to achieve bulk density approaching the theoretical bulk density of the alloy material, a vacuum less than 200 millitorr must be employed.

DETAILED DESCRIPTION OF THE INVENTION

In accordance with this invention, a method is provided which solves the problem of making substantially fully dense small magnets, those having a mass less than 30 grams and preferably less than 20 grams, by compressing a neodymium iron boron alloy in a die and punch assembly wherein the pressure exerted on the powder is at least 10 kpsi, preferably from 15 to 40 kpsi and most preferably 20 to 35 kpsi, the temperature is controlled within the range of 550° C. to 750° C., preferably from about 600° to 700° C., and during the pressing or densifying process, the entire operation is under a vacuum of less than 200 millitorr. Preferably the vacuum should be less than 100 millitorr and for best results less than 10 millitorr. The parameters set forth are closely interrelated, the operation of the process being dependent upon the particular combination of conditions employed. For example, at the lower limits of pressing pressure, higher temperatures within the designated range must be employed. Also, at the lower extremes of either temperature or pressing pressure, better than the minimum vacuum is necessary. The density and remanence are also interrelated in a manner such that should the conditions not produce a substantially fully dense magnet, a remanence of at least 7 kilogauss will not be obtained.

During the pressing operation, the grain size of the magnetic alloy will increase. Therefore, it is important to begin the process with an alloy having a grain size that is smaller than that desired for providing the highest magnetic properties. The most suitable grain size for achieving the highest magnetic properties and energy product for neodymium iron boron alloys is from about 1500 to 2000 angstroms and preferably about 1800 angstroms. The starting alloy powder for insertion into the die should have a grain size from about 100 to about 1500 angstroms, preferably from about 200 to about 1200 angstroms and for best results, from about 500 to about 1200 angstroms.

The particle size of the magnetic alloy utilized in this process is also important with regard to the process steps employed. When the particle size is greater than 250 micrometers, the consolidation process is unreasonably prolonged. This in turn causes a further disadvantage in that the longer the magnetic alloy is at high temperature the larger the grain sizes will be as a result thereof. Further, a starting particle size less than 45 micrometers increases the susceptibility of the particles to oxidation and a loss in the desired magnetic properties.

In the practice of the method of this invention, the crushed melt spun neodymium iron boron powder having the stated particle size is loaded into a die or dies (should a device be employed capable of simultaneously pressing a plurality of magnets) which contain a movable punch or punches to which high forces can be applied. The press chamber formed by the die and the punch is closed to exclude ambient atmosphere and flushed with an inert gas such as, nitrogen, argon or the like. Inert gas flow is stopped and a vacuum is applied by opening a valve that connects a vacuum pump to the chamber. A means is provided to heat the chamber such as an induction heating coil connected to a power supply. Heating is begun while a low pressure is applied to the powder in the chamber. After a vacuum of less than 200 millitorr, preferably less than 100 millitorr and most preferably less than 10 millitorr and a die temperature of at least 550° C. is reached a densifying pressure of at least 10 kpsi and preferably from 15 kpsi to about 40 kpsi and most preferably from 20 to 35 kpsi is applied to the powder specimen within the chamber. It is desirable to employ pressing pressures in the preferred and most preferred ranges because at the minimum pressing pressures, full compaction is not always obtained within the minimum time and low temperatures, while at the maximum pressing pressures, die wear is increased. The pressing pressure at temperature is maintained until the desired densification occurs. This is generally accomplished within 2 to 5 minutes. It is preferred that consolidation be concluded within 3 minutes to limit the period of time at temperature and thereby limit the amount of grain growth. After the consolidation of the magnetic powder in the chamber takes place, the vacuum is removed, the induction power is switched off and the completed part is permitted to cool. The press chamber is then opened and the part removed from the die. While the cooling step can be permitted to occur naturally, it is desirable to cool the consolidated magnet quickly to limit the growth in grain size and also from an economic viewpoint to permit the reuse of the die and punch assembly in the preparation of the next magnet. Cooling can be enhanced by conducting a flow of inert gas around the completed part. The completed part can be ejected from the die at any temperature ranging from room temperature to 600° C. However, to achieve maximum die life and maintain magnet dimensional tolerance, the preferred ejection temperature range is from 300° C. to 400° C.

The magnetic rare earth alloy to be used as the starting material in accordance with this invention may be formed by any suitable technique provided that the resulting grain size is from about 100 angstrom to about 1500 angstrom including casting, casting followed by particle size reduction including grinding an the like, atomizing or melt spinning. Alloys prepared by melt spinning are preferred for use in accordance with this invention because closer control of the grain size can be obtained. The method and apparatus employed for preparing melt spun ribbons for use in accordance with this invention are described in U.S. Pat. No. 4,402,770 issued Sept. 6, 1983, which patent is incorporated herein by reference.

A second reason the ribbons prepared in the melt spinning process are particularly suitable as starting alloy is that they are readily crushed to the desired particle size.

In the preparation of permanent magnets in accordance with this invention, any suitable neodymium iron boron alloy having permanent magnetic properties may be used, such as for example, the ternary alloys of Nd-Fe-B and in addition those containing an optional element or elements added in small amounts in the preparation of the alloy, to control the grain size of the crystallites. Suitable elements include Ti, V, Nb, Ta, Cr, Mo, W, Mn, Al, Zn, and Tr. Of these Al, Ti, Mo, Nb and Ta are preferred as their addition results in a degree of anisotropy when melt spun in accordance with the procedure described hereinafter and in co-pending application U.S. Ser. No. 159,637, filed on Feb. 23, 1988 assigned to the same assignee as this application and entitled "A Method of Preparing Neodymium-Iron-Boron Magnets Having Anisotropic Alignment and a Uniform Grain Size" by T. W. Martin and D. K. Chatterjee, which is incorporated herein by reference. Suitable alloys include $Nd_{15}Fe_{77}B_8$
$Nd_{15}Fe_{73}B_8Ti_4$
$Nd_{18}Fe_{785}B_{5.5}AL$
$Nd_2Fe_{14}B$
$Nd_{15}Fe_{73}B_8AL_4$
$N_{15}Fe_{73}B_8Mo_4$
$Nd_{15}Fe_{73}B_8Ta_4$
$Nd_{15}Fe_{73}B_8Nb_4$ and the like. Particularly suitable and preferred neodymium iron boron alloys are those which form the $Nd_2Fe_{14}B$ phase which is the main magnetic phase in neodymium iron boron alloys that gives rise to magnets having the highest properties when anisotropically aligned.

Those materials prepared in accordance with U.S. application Ser. No. 159,637 referred to above are generally of too high a grain size for starting materials in the invention as in accordance with that invention the grain size of the magnetic product has maximum magnetic properties. Because of the subsequent operation employed in this invention, that being the consolidation of the particles, a smaller grain size should be employed as the starting material because grain growth will occur during the hot consolidation step of this procedure. The grain size of the starting alloy can be readily achieved in accordance with the procedure known as melt quenching and described in the previously mentioned application, by increasing the quench rate of the melt spun alloy by increasing the wheel speed or lowering the rate of deposition of the wheel.

In the practice of this invention, any suitable material may be employed in the preparation of the die and punch, such as, for example, graphite, tungsten carbide, titanium, molybdenum, silicon carbide, an alloy of molybdenum, titanium and zirconium where the total content of titanium and zirconium is less than 5 weight percent sold under the trade designation "TZM" by Schwartz Ropf Development Corp. and the like. Silicon carbide and TZM are particularly suitable materials for the die and the punch because full density for the magnetic part is readily achieved, the part is extracted from the die without complication and the life of the die and punch in high volume production is much greater than other materials or combination of materials.

The invention is further illustrated by the following examples:

EXAMPLE 1

Preparation of NdFeB Alloy

The constituents of an alloy having the composition $Nd_{15}Fe_{77}B_8$ are weighed out into a crucible and heated to 1550° by induction for 20 minutes then cast into a water cooled copper mold. After solidification the casting is broken into chucks and placed in a quartz crucible of a melt spinning apparatus generally described in U.S. Pat. No. 4,402,770 (incorporated herein by reference). The crucible has a diameter of 30 mm and the orifice at the bottom thereof a diameter of 1.4 mm. The chamber surrounding the melt spinning apparatus is evacuated to 50 milliTorr and back filled with argon to pressure of 760 milliTorr. The alloy charge is heated by induction to 1550° and ejected by a pressure of 3 psi of argon within the crucible through the orifice onto a spinning copper quench wheel having a diameter of 12 inches and rotating at a speed of 1000 RPM. The orifice is positioned above the quench wheel a distance of about 27 μm. The ribbon of alloy obtained from the wheel have an average crystallite grain size, as measured by transmission electron microscope of 800 to 1000 angstroms.

EXAMPLE 2

Ribbons prepared according to Example 1 are crushed to obtain an average particle size of from 45 μm to 250 μm. This material is loaded into a cylindrical silicon carbide die having a diameter of 6 mm and a depth of 15 mm. A TZM alloy punch is deposed over the die cavity. The entire assembly is positioned within an air tight chamber capable of being evacuated.

The air tight chamber is flushed with argon for one-half minute and then evacuated by opening a valve to a vacuum pump. The powder is heated by induction heating while a slight pressure is applied to the punch by means of a hydraulically activated press. When the desired vacuum and temperature are reached, the desired pressure, as shown in the Table, is applied to the punch and the alloy powder within the die consolidated for a period of 3 minutes at the end of which the power to the induction heating means is turned off, the vacuum released and nitrogen passed through the air tight chamber to cool the consolidated alloy. The cylindrical alloy part is ejected from the die at 300° C. The pressing conditions and results thereof are set forth in the following table.

TABLE I

Results of Hot Consolidation Experiments

| Sample | Pressing Temp (°C.) | Pressure (kpsi) | Vacuum/Gas (mTorr) | Density gm/cm3 | Br (KG) |
|---|---|---|---|---|---|
| 1* | 550 | 20 | 200 | 6.02 | 6.5 |
| 2 | 550 | 20 | 10 | 6.89 | 7.8 |
| 3 | 550 | 20 | 1 | 7.30 | 7.9 |
| 4 | 550 | 20 | 100 | 6.63 | 7.2 |
| 5 | 750 | 20 | 100 | 7.58 | 8.1 |
| 6 | 550 | 35 | 100 | 6.80 | 7.4 |

*Because the pressing temperature, pressure and vacuum were all at minimum values, compaction with accompanying high remanence values could not be obtained.

The density measurements indicated above are determined by weighing and calculating the volume of the cylindrical pressed parts from height and diameter measurements and therefore are not as precise as possible. However, the values are indicative of the improvement obtained in density and remanence as the significant variables are altered and also in the correlation of density with remanence.

What is claimed is:

1. A method of making high energy Nd-Fe-B permanent magnets having a mass less than 30 grams and a remanence of at least 7 kilogauss which comprises introducing into a cavity formed by a die and punch a Nd-Fe-B powder having a particle size of from 45 μm to 250 μm and a grain size of from 100 Å to 1500 Å compressing the powder under a vacuum of less than 200 millitorr at a temperature of from about 550° C. to 750° C. under a die-punch pressure of at least 10 kpsi.

2. The method of claim 1 wherein the vacuum is less than 100 millitorr.

3. The method of claim 1 wherein the vacuum is less than 10 millitorr.

4. The process of claim 1 wherein the die and punch are made of silicon carbide.

5. The process of claim 1 wherein the die and punch are made of an alloy of molybdenum, titanium and zirconium where the total concentration of the titanium and zirconium present in the alloy is less than 5% by weight.

6. The process of claim 1 wherein the die is made of silicon carbide and the punch is made of an alloy of molybdenum, titanium and zirconium where the total concentration of the titanium and zirconium present in the alloy is less than 5% by weight.

7. The process of claim 1 wherein the grain size of the Nd-Fe-B powder is 200 Å to 1200 Å.

8. The process of claim 1 wherein the grain size of the Nd-Fe-B powder is 500 Å to 1200 Å.

9. The process of claim 1 wherein the die punch pressure is from 15 to 40 kpsi.

10. The process of claim 1 wherein the die punch pressure is from 20 to 35 kpsi.

11. The process of claim 1, wherein the pressing pressure at temperature is maintained for 2 to 5 minutes.

12. The process of claim 1 wherein the pressing pressure at temperature is maintained for 2 to 3 minutes.

* * * * *